US006584745B1

(12) United States Patent
Johansson

(10) Patent No.: US 6,584,745 B1
(45) Date of Patent: Jul. 1, 2003

(54) FLOOR CONSTRUCTION COMPRISING JOISTS PROVIDED WITH LEVEL ADJUSTING SPACER SCREWS, JOISTS AND SPACER SCREWS THEREFOR

(75) Inventor: Lennart Johansson, Mariestad (SE)

(73) Assignee: Nivell System AB, Mariestad (SE)

( * ) Notice: Subject to any disclaimer, the term of this patent is extended or adjusted under 35 U.S.C. 154(b) by 0 days.

(21) Appl. No.: 09/913,895

(22) PCT Filed: Apr. 10, 2000

(86) PCT No.: PCT/SE00/00679

§ 371 (c)(1),
(2), (4) Date: Aug. 21, 2000

(87) PCT Pub. No.: WO00/63509

PCT Pub. Date: Oct. 26, 2000

(30) Foreign Application Priority Data

Apr. 20, 1999 (SE) ..... 9901391

(51) Int. Cl.[7] ..... E04F 15/00

(52) U.S. Cl. ..... 52/480; 52/126.4; 52/126.5; 52/126.7; 52/724.1; 248/188.4

(58) Field of Search ..... 52/126.1, 126.4, 52/126.5, 126.6, 126.7, 365, 403.1, 480, 724.1, 726.2; 248/656, 188.4

(56) References Cited

U.S. PATENT DOCUMENTS

| | | | | | |
|---|---|---|---|---|---|
| 2,940,784 | A | * | 6/1960 | Fell | 74/89.35 |
| 3,127,703 | A | * | 4/1964 | Eshelman | 52/365 |
| 3,308,587 | A | * | 3/1967 | Gilroy et al. | 52/126.5 |
| 3,511,001 | A | * | 5/1970 | Morgan, Jr. | 52/126.5 |
| 3,606,704 | A | * | 9/1971 | Denton | 52/167.8 |
| 4,108,407 | A | * | 8/1978 | Cable et al. | 248/656 |
| 4,360,993 | A | * | 11/1982 | Tomokazu et al. | 52/365 |
| 4,662,807 | A | * | 5/1987 | Lien et al. | 411/368 |
| 5,412,917 | A | * | 5/1995 | Shelton | 52/403.1 |
| 5,511,760 | A | * | 4/1996 | Kambara | 248/650 |
| 5,661,931 | A | * | 9/1997 | Johansson | 52/126.7 |
| 6,070,381 | A | * | 6/2000 | Blumer | 52/403.1 |
| 6,363,685 | B1 | * | 4/2002 | Kugler | 52/745.05 |

FOREIGN PATENT DOCUMENTS

| | | |
|---|---|---|
| DE | 29 15 115 | 12/1979 |
| DE | 37 34 797 | 5/1989 |
| EP | 0 452 600 | 10/1991 |
| EP | 508 986 | 11/1998 |
| SE | 501 517 | 3/1995 |
| SE | 503 395 | 6/1996 |

* cited by examiner

*Primary Examiner*—Carl D. Friedman
*Assistant Examiner*—Brian E. Glessner
(74) *Attorney, Agent, or Firm*—Nixon & Vanderhye P.C.

(57) ABSTRACT

A building construction for floors including joists that have vertical, threaded, through-running holes for level-adjusting spacer screws, which protrude from the joist on its underside for adjusting the top side of the joist to a desired level, an elastic damping body being arranged at the anterior screw portion and having an outer part, which forms a resilient connection between the screw and the substructure, and an inner part, which is located inside a central hole in the screw. The inner part forms a resilient engagement element for cooperation with an inner support surface in the bottom part of the screw. An attachment element for anchoring the screw to the substructure extends through a central hole in the damping body. The cross section of the inner part is greater than the diameter of the bottom part.

56 Claims, 5 Drawing Sheets

FLOOR CONSTRUCTION COMPRISING JOISTS PROVIDED WITH LEVEL ADJUSTING SPACER SCREWS, JOISTS AND SPACER SCREWS THEREFOR

BACKGROUND OF THE INVENTION

The present invention relates to a building construction for floors, walls or ceilings with a rigid substructure. The construction includes a plurality of parallel joists and at least one covering layer supported by the joists, which joists each include an elongate, form-stable body with a first side that is flat and faces the covering layer and a second side that faces the substructure. The joist body has threaded, through-running holes, spaced from each other and extending between and perpendicularly to the first and second sides, and load-carrying level-adjusting spacer screws that are screwed into the holes with their anterior screw portions protruding from the joist body on its second side to adjust the first side of the joist body to a desired level. The spacer screws have a length such that their posterior screw portions, situated inside the joist body to maintain sufficient thread engagement, have a part-length of at least 10 mm, preferably at least 20 mm, whilst the anterior screw portions have a part-length of at least 1 mm, preferably at least 5 mm, to form an air gap, which extends from the second side of the joist body. Each level-adjusting spacer screw is provided with a central hole, extending from the posterior end of the level-adjusting spacer screw to a location a distance from the anterior end of the level-adjusting spacer screw to form a bottom part with an inner support surface. The level-adjusting spacer screw is arranged to be anchored to the substructure by means of an attachment element, extending through a central hole in the bottom part, an elastic damping body being arranged at the anterior screw portion, which damping body has a central hole and includes an outer part, arranged to form a spring connection between the level-adjusting spacer screw and the substructure, and an inner part, arranged to be received in the central hole in the level-adjusting spacer screw. The invention also relates to joists and level-adjusting spacer screws of the kind described above.

Building constructions of the kind described above are known through SE-501 517 C2 and SE-503 395 C2 and, in practice, have proved to be advantageous for providing good circulation of air and for adjusting the correct level without using chemical fillers. The last-mentioned patent also describes special spring bands or the like for endowing a floor with resilient qualities.

For new constructions and re-constructions, however, sound-proofing requirements have been made more rigorous with respect to sounds from air and forces, such as by stepping, that act upon the building construction and are transmitted below the substructure supporting the building construction.

SUMMARY OF THE INVENTION

The object of the present invention is to provide floor constructions and joists for floor constructions that meet the new requirements for air and step sound-proofing.

The floor construction as well as the joists and the level-adjusting spacer screws in accordance with the invention are configured such that the inner part of the damping body forms a resilient engagement element for co-operation with the inner support surface of the bottom part, the attachment element being arranged to extend through the central hole of the damping body, and the inner part has a cross-sectional dimension that is greater than the diameter of the central hole of the bottom part.

In accordance with a preferred embodiment of the invention, the damping body includes an internal stop sleeve, extending through its central hole, for cooperation with the head of the attachment element and the substructure, the attachment element extending through the stop sleeve. It is thereby possible to use an automatic driving-in tool for the attachment elements so that they can be anchored in the substructure without the damping body being compressed to a permanent compressed assembly position.

BRIEF DESCRIPTION OF THE DRAWINGS

The invention will be further described in the following with reference to the drawings, in which.

DETAILED DESCRIPTION OF PREFERRED EMBODIMENTS

Figure 1:
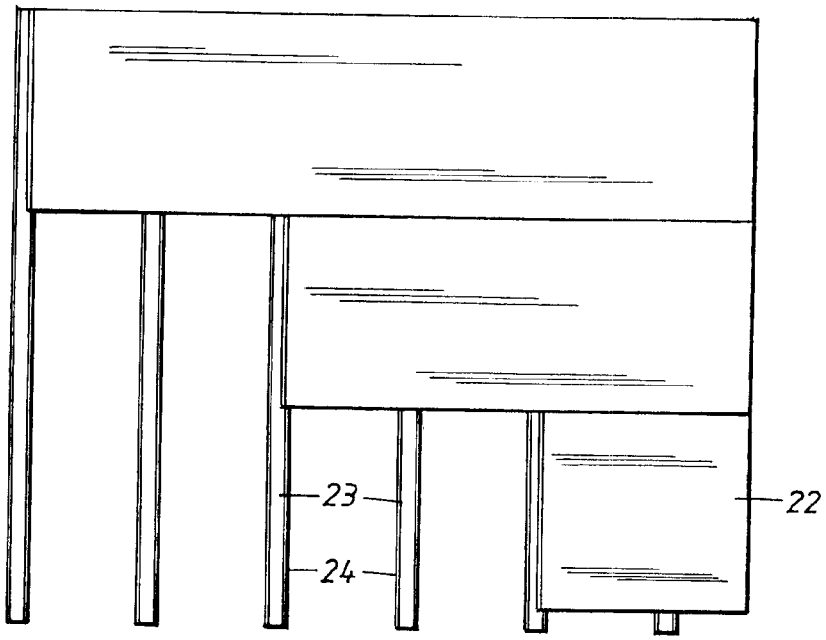
FIG. 1 is a top view of a first floor construction in accordance with the invention during construction.
Figure 2:
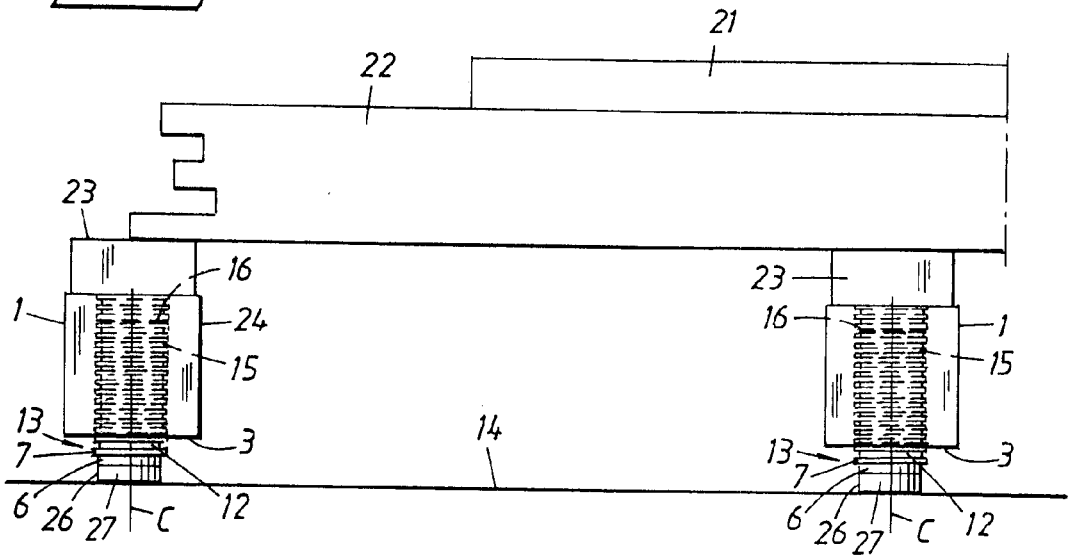
FIG. 2 is an end view of the floor construction in accordance with FIG. 1.
Figure 3:
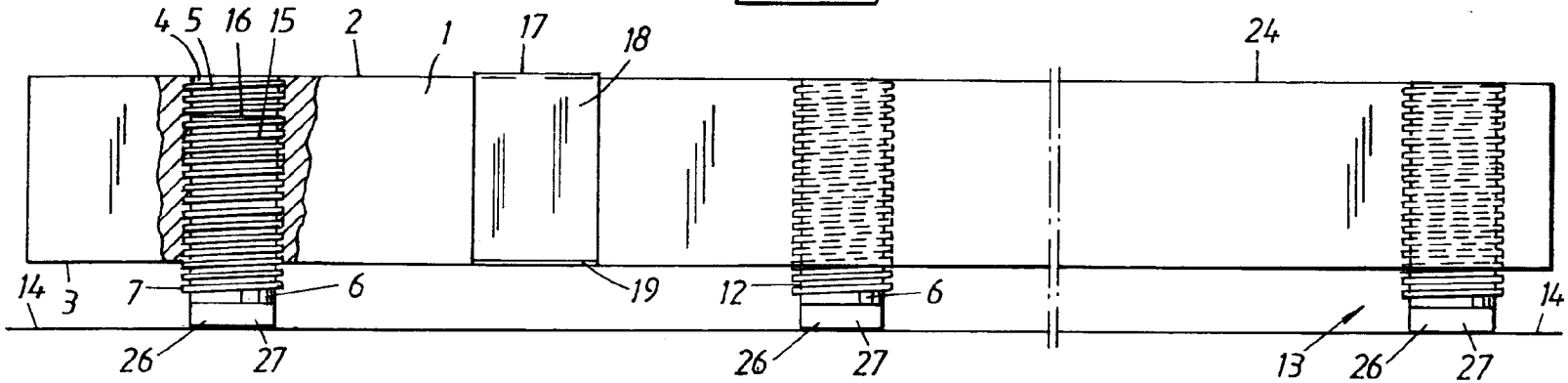
FIG. 3 is a side view of a joist that forms part of the floor construction in accordance with FIGS. 1 and 2.
Figure 4:
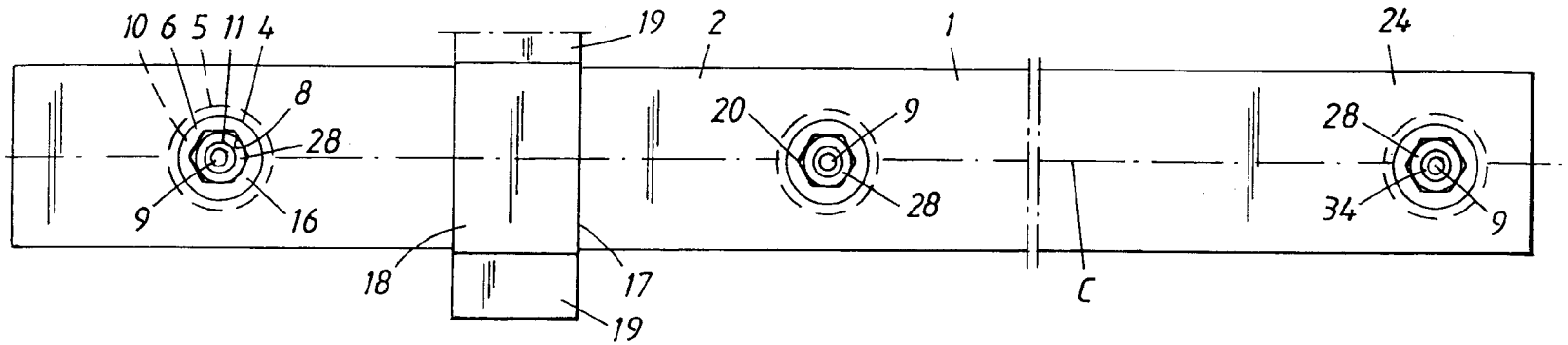
FIG. 4 is a top view of the joist in accordance with FIG. 3.

FIGS. 1 and 2 show schematically parts of a floor construction comprising two covering layers in the form of a top layer 21 and a support layer 22, spring elements 23, and a plurality of parallel joists 24. The floor construction is built on a rigid, stable, supporting substructure 14, for instance a concrete floor. The joists, shown in more detail in FIGS. 3 and 4, comprise a body 1 that has a generally straight, elongate shape. The joist body 1 has a rectangular cross section and has a flat outer side 2 and a flat inner side 3, which is parallel to the outer side 2. The letter C denotes a vertical central plane in the joist body 1. Parts of a similar floor construction are shown schematically in FIG. 5, but THE spring element 23 is omitted in this instance.

The joist body 1 has a plurality of circular, vertical, through-running holes 4, arranged a pre-determined distance from each other and extending between and perpendicularly to the outer side 2 and inner side 3. The distance between two proximate holes 4 is suitably between 5 and 200 cm, a preferred distance being between 30 and 60 cm. The distance chosen in each individual case between two adjacent holes 4 is suitably constant along the entirety of the joist body 1. The wall of the hole 4 has threads 5 with predetermined pitch, which threads 5 are favorably effected directly in the joist body 1, so that no special inserts are required and so that drilled and threaded holes 4 can be provided simply and quickly and, advantageously, in one and the same procedure. The hole 4 is threaded in its entirety, i.e., from the outer side 2 to the inner side 3 of the joist body.

The joist further comprises a plurality of load-carrying level-adjusting spacer screws 6 in the shape of straight, circular cylinders, i.e., each level-adjusting spacer screw has a constant diameter from one end portion to the other. Each level-adjusting spacer screw 6 has an external thread 7 with the same pitch as the thread 5 of the wall of the hole and is further provided with an internal central hole 8, extending from the posterior end of the level-adjusting spacer screw 6 to a location a short distance from the anterior end 31 and having a cross-sectional dimension that constitutes more than 60 per cent of the diameter of the level-adjusting spacer screw 6, although not greater than that sufficient wall thickness, for instance 3–6 mm, remains. The hole 8 is provided with an engagement member 20, which is freely accessible from the outside for co-operation with a turning device (not shown). The entire level-adjusting spacer screw 6 is externally threaded, i.e., the thread 7 extends from the anterior end of the level-adjusting spacer screw 6 (apart from a small terminal bevelling) to its posterior end. In the embodiment shown, the hole 8 is fashioned as a hexagonal hole, the walls of which thus form the engagement member 20 for receiving a corresponding turning device in the form of a hexagonal key, the hexagonal hole 8 thus having limited depth, i.e., not being through-running, to form a bottom part 10, which in turn is provided with a narrower, through-running, central hole 11, intended for receiving an elongate attachment element 9, which is forced into the substructure 14 to fix the level-adjusting spacer screw 6 (and thus the joist) to the substructure 14 without preventing rotation of the level-adjusting spacer screw 6 so that the level can be set and adjusted after this fixing.

The level-adjusting spacer screws 6 are thus screwed into the holes 4 of the joist body 1 to protrude from the joist body 1 with their anterior portions 12, partly to form a predetermined air gap 13 underneath the joist body 1, partly to enable the level of the flat outer side 2 of the joist body 1 to be adjusted as desired. The remaining portion of the level-adjusting spacer screw 6, i.e., the posterior portion 15 situated inside the joist body 1, is in firm thread engagement with the joist body 1, the posterior end 16 of the level-adjusting spacer screw 6 being situated below or flush with the outer side 2 of the joist body.

The level-adjusting spacer screw 6 has a constant diameter, so chosen that it is sufficiently robust to be able to support the loads that will rest and act upon the joists without the level-adjusting spacer screws 6 bending and so that the thread-engagement surface is sufficiently large for firm thread engagement to be provided even when the posterior end 16 of the level-adjusting spacer screw 6 is situated below the outer side 2 of the joist body. A suitable diameter is 10–40 cm, preferably 15 25 cm. Further, the level-adjusting spacer screw 6 has a length chosen, in part such that firm thread engagement is provided even when the posterior end 16 of the level-adjusting spacer screw 6 is situated a distance from and below the outer side 2 of the joist body 1, i.e., the portion 15 situated inside the joist body 1 is sufficiently long in relation to the chosen diameter, and in part such that adjustment to a desired maximum level can be achieved. A suitable length, in the assembled and finished construction, is 0–3 cm longer than the distance between the outer side 2 and the inner side 3. At the beginning of the assembly process the length can be greater, so that a section of the level-adjusting spacer screw 6 also protrudes from the outer side 2 of the joist body when the level has been set, which protruding section is then removed and the surface of the cut finished flush with the outer side 2 of the joist body. In each individual case, when the level-adjusting spacer screw 6 is utilized at a maximum level setting, the length of the posterior portion 15 of the level-adjusting spacer screw 6, situated inside the joist body 1, is at least 10 mm, preferably at least 20 mm, depending on the stress that will act upon the joist body 1 and the level-adjusting spacer screws 6 from the remaining part of the building construction and external loads. The anterior portion 12 has a part-length of at least 1 mm, preferably at least 5 mm, to form an air gap 13, extending from the inner side 3 of the joist body 1.

In the embodiment shown, the level-adjusting spacer screws 6 are arranged in the middle of the joist body 1, i.e., in the central plane of the joist body 1. In an alternative embodiment, they can be arranged in two rows on respective sides of the central plane, if the width of the joist body 1 permits this. In this way, the joist can be placed in an upright position on a floor substructure with the outer side 2 in a horizontal position.

The joist further comprises support elements 17 for insulation materials. In the embodiment shown, these support elements 17 consist of angle sections, each having a U-shaped component 18 with two parallel side pieces and also two wings 19 extending laterally away from each other at right angles to support insulating boards 25 between two joist bodies 1, the U-shaped part 18 being designed to straddle the joist body 1 from above to connect the two parallel side pieces by means of a connection piece, which is in contact with the outer side 2 of the joist body 1.

The joist is easy to manufacture and easy to fit on all kinds of substructures for floors, walls and ceilings. The joist body 1 itself can consist of any suitable material whatsoever, such as wood, plastic or metal, providing a form-stable joist body with the requisite load-bearing capacity. The joist body 1 can be solid or hollow, in which latter case it must be ensured that the through-running holes 4 have sufficient wall surfaces for threading. The level-adjusting spacer screws 6 are suitably manufactured of a hard plastic material that is resistant to aging and provides sufficient load-bearing capacity.

The joist bodies 1 can be delivered in different sizes as well as in continuous lengths to be cut with ordinary tools, when the joist body is made of wood or plastic, and joined in an appropriate way. The level-adjusting spacer screws 6 can also be fitted to the joist body 1 on site, in which case the joist body 1 can be pre-drilled or, alternatively, the drilling can be done on site.

The floor construction shown in FIGS. 1 and 2 is a so-called combined sports floor in that the top layer 21 consists of a resilient spring layer, for instance a rubber mat, which is covered on site with a layer of polyurethane or with a prefabricated special mat with built-in elasticity. The support layer 22 usually consists of wood board or particle board, resting directly on the spring elements 23, which in turn rest on the joist bodies 1. The spring elements 23 have an elongate shape with a rectangular cross section and a width equal to or only somewhat smaller than the width of the joist body 1. The spring elements 23 extend continuously along the joist bodies 1. They consist of a compressible, homogenous, foamed, rubber-like material with a density of 100–400 kg/m$^3$, preferably 195–200 kg/m$^3$ and a compression modulus of 1–20 MPa, preferably 3–5 MPa. In accordance with a preferred embodiment, the joist-like spring elements 23 are manufactured of a recycled polyurethane material. The spring elements 23 have a thickness of 10–50 mm, preferably 30 mm.

In accordance with the present invention, the joist 24 comprises one elastic damping body 26 for each level-adjusting spacer screw 6, which damping body 26 is arranged to act between the level-adjusting spacer screw 6 and the substructure 14 to absorb vibrations in the floor construction that can arise due to stepping sounds and air sounds. The damping body acts as a resilient connection between the floor construction and the substructure so that the floor construction likewise obtains resilient qualities and does not feel rigid. The damping body 26 can thus be described as a vibration-damping, resilient spacing cushion.

Figure 5:
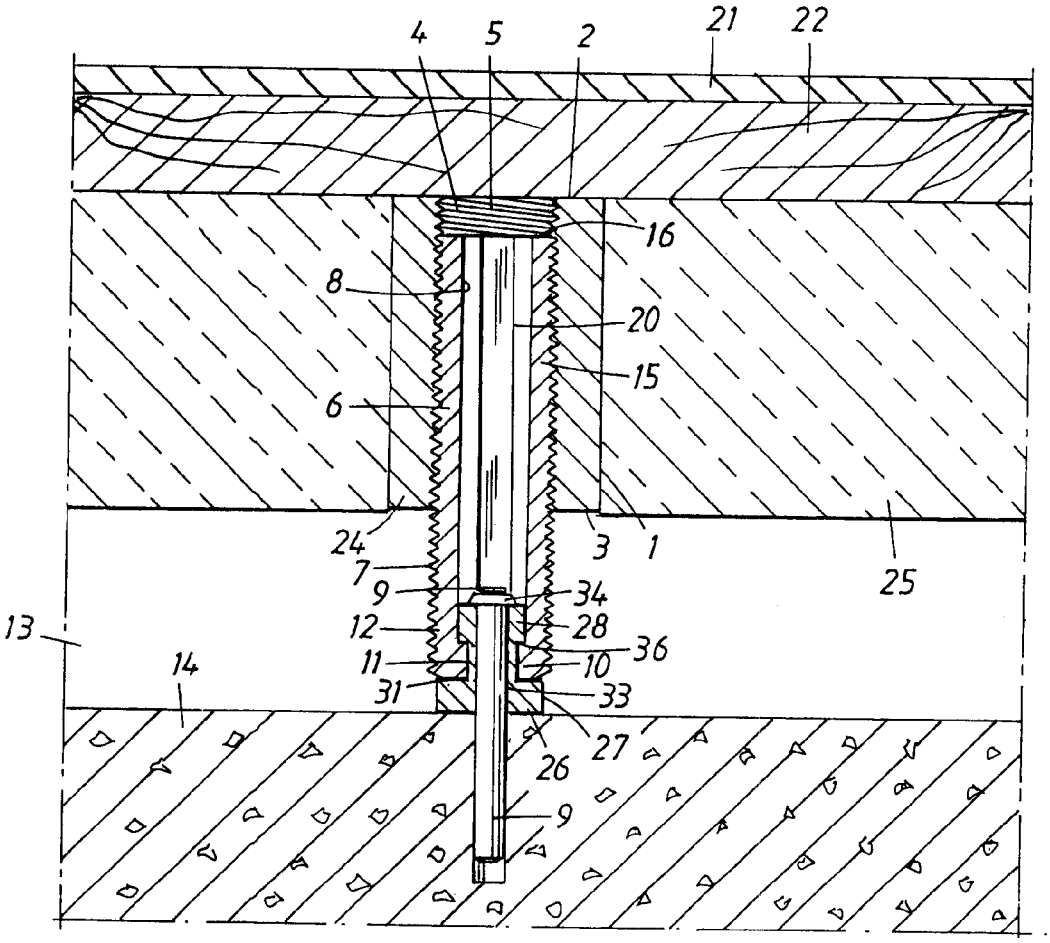
FIG. 5 is a cross-sectional view of a second floor construction in accordance with the invention.
Figure 6:
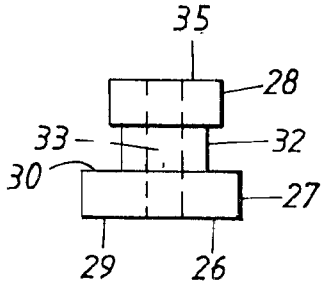
FIG. 6 is a side view of a damping body for the floor constructions in accordance with FIGS. 1 and 5.

In the embodiment shown in FIGS. 5 and 6, the damping body 26 has an outer part 27 and an inner part 28. The outer part 27 has a free anterior end surface 29 for contacting the substructure 14 and a posterior end surface 30 for contacting the anterior end surface 31 of the level-adjusting spacer screw 6. The inner part 28 is situated inside the hexagonal hole 8 of the level-adjusting spacer screw 6 and has a diameter greater than the central hole 11 and somewhat smaller than the distance between two opposite sides in the hexagonal hole 8. In this way, the inner part 28 acts as a resilient engagement element for co-operating with an inner support surface 36 of the bottom part 10 of the level-adjusting spacer screw 6.

In the preferred embodiment shown in FIGS. 5 and 6, the damping body 26 is made in one piece, and the outer and inner parts 27, 28 are united by an intermediary part 32, having a diameter smaller than the diameter of the inner part 28 and equal to or smaller than the central hole 11 in the bottom part 10. The damping body 26 has an axial, through-running hole 33 for receiving the attachment element 9, which is brought into firm engagement with the substructure 14 directly in the same, when the attachment element 9 is in the shape of a screw, or via a pre-drilled hole, as shown in FIG. 5. The level-adjusting spacer screw 6 and the damping body 26 are anchored to the substructure 14 with the aid of the attachment element 9 and, after anchoring, the damping body 26 is elastically compressible, partly to yield resiliently to the stresses to which the level-adjusting spacer screw 6 is subjected when local loads are carried by the floor construction, and partly to absorb the vibrations that arise in the floor construction because of stepping sounds and air sounds in the actual floor construction as well as in the space above the floor construction. The beneficial effects described are enhanced by the attachment element 9 being free from contact with the level-adjusting spacer screw 6. Thus, the attachment element 9 has a head 34 that contacts the upper end surface of the inner part 28 of the damping body 26 in such a way that this inner part 28 is not permanently compressed between the head 34 of the attachment element 9 and the ledge 36 of the bottom part 10 or so that it is compressed only to a modest degree and without becoming rigid. The attachment element 9 shown in FIG. 5 consists of an expansion sleeve, provided with the head 34 and introduced into a drilled hole in the substructure 14, and an expansion nail or peg, which is forced into the expansion sleeve to form a strong joint with the substructure. Alternatively, the attachment element is a concrete nail or screw, provided with the head and which does not require any pre-drilling.

The damping body 26 is manufactured of a suitable elastic material, e.g., a rubber material or a plastic material with rubber-like qualities. One of the currently most suitable materials is polyurethane with a hardness of 65 Shore. Generally, the Shore number is in the range of about 30–90, preferably about 55–75 (on Scale A).

The dimensions of the damping body 26, especially the height of the outer part 27, i.e., its axial extension, are selected from case to case depending on a plurality of factors, such as the Shore number of the material, the desired damping effect, the desired spring effect, and the distance between the level-adjusting spacer screws 6. In normal circumstances, the outer part 27 of a damping body 26 of polyurethane with a Shore number of 65 can have a height of about 8 mm, and the height of the inner part 28 can be about 8 mm. The height of the intermediary part 32 is 8 mm to provide a groove, in which the bottom part 10 of the level-adjusting spacer screw 6 is received with a relatively close fit. Due to the central hole 33 of the damping body 26 and the elasticity of the damping body 26, the inner part 28 can be radially compressed to reduce its circumference so that the inner part 28 can be forced through the central hole 11 of the bottom part 10 of the level-adjusting spacer screw 6 to be fixed inside the same to form a permanent joint.

The damping body 26 can comprise one or several flat, annular, elastic supplemental washers with central holes corresponding to the central hole 11 of the rest of the damping body 26, which supplemental washers are selected from a reserve of supplemental washers of the same or different thicknesses and with the same or different Shore numbers and of the same or different materials compared to the rest of the damping body 26. Such supplemental washers are applied to the anterior end surface of the outer part 27 of the damping body 26 to form part of the outer part 27 as a superimposed part.

In an alternative embodiment (not shown), the damping body consists of two separate components, namely an outer component and an inner component, which components correspond to the outer and inner parts 27, 28 of the damping body 26 shown in FIGS. 5 and 6. In this alternative embodiment, the inner component can be introduced into the level-adjusting spacer screw 6 from the other end, for instance together with the attachment element 9, and the central hole 1 in the bottom plate 10 can be made smaller to approximate the diameter of the attachment element 9 (with play). If so desired, the outer, separate component can be secured to the end surface 31 of the level-adjusting spacer screw 6, for instance with an adhesive agent.

Figure 7:
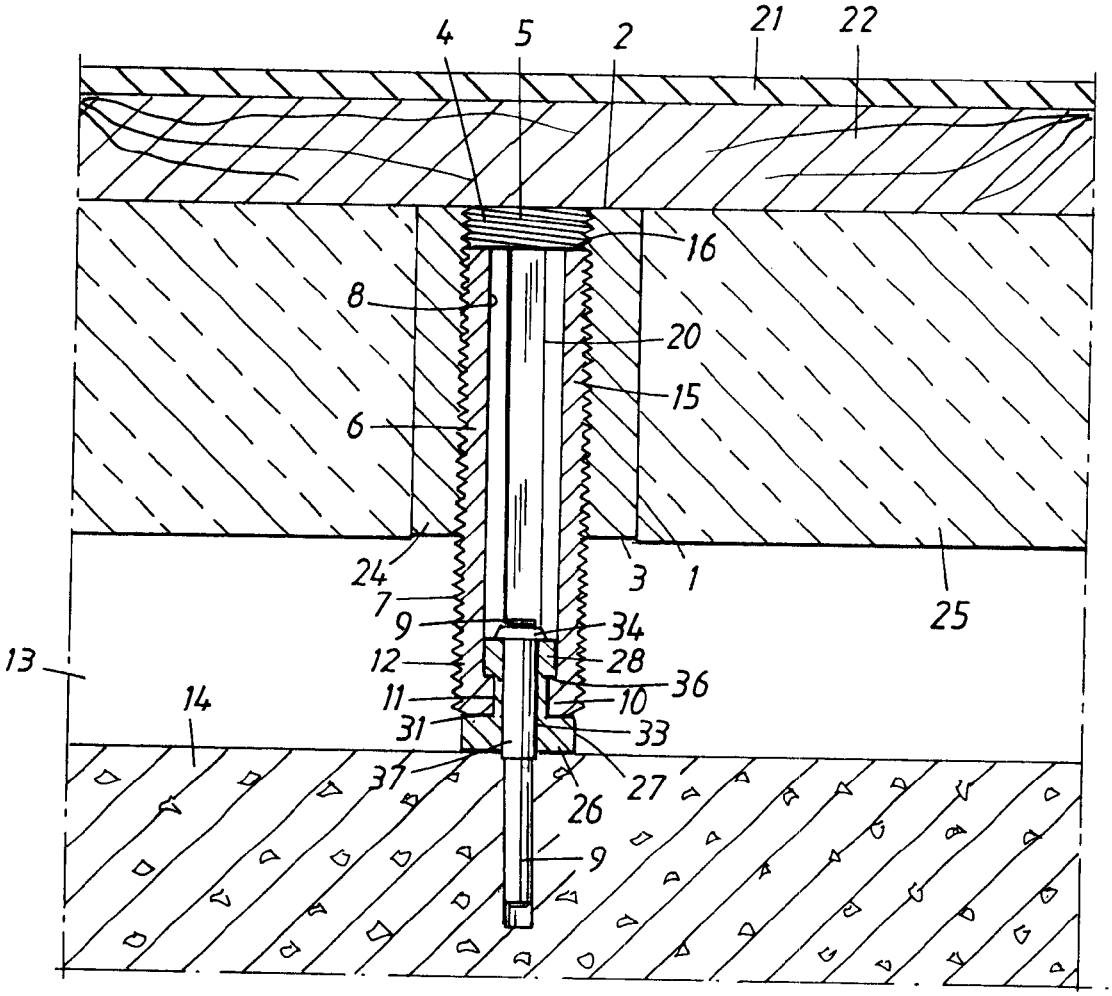
FIG. 7 is a cross-sectional view of a third floor construction in accordance with the invention.
Figure 8:
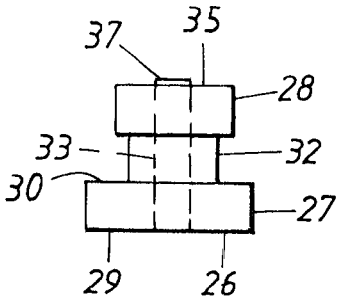
FIG. 8 is a side view of a damping body similar to the one in FIG. 6, but provided with a stop sleeve.
Figure 9:
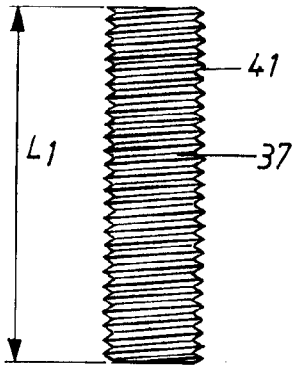
FIG. 9 is a side view of a stop sleeve in accordance with FIG. 8.

FIGS. 7 and 8 show a damping body 26, which is similar to the one shown in FIGS. 5 and 6 and, furthermore, which is provided with a stable stop sleeve 37 for co-operating with the attachment element 9 and the substructure 14. The stop sleeve 37, which is shown in more detail in FIG. 9, is only a few millimetres longer than the damping body 26. When the attachment element 9 is driven in with the aid of an automatic driving-in tool, the head 34 of the attachment element 9 impinges on the upper end of the stop sleeve 37, whereupon the stop sleeve 37 is forced down a distance into the substructure 14, as illustrated in FIG. 7. The additional length of the stop sleeve 37, one or a few millimetres, corresponds to the penetration of the stop sleeve into the substructure 14. It is understood that the attachment element 9 will not then compress the inner part 28 to a permanently compressed assembled position but will contact the upper end surface 35 of the inner part 28 without appreciable pressure. Although it is beneficial and desirable to avoid such compression of the inner part 28 during assembly, it can be permitted in certain cases if it is insignificant, such as one or a few millimetres. The object is to be able to utilize the elastic capacity of the inner part 28 to as great a degree as possible, preferably in its entirety. This object is promoted by the proposed stop sleeve 37.

Figure 10:
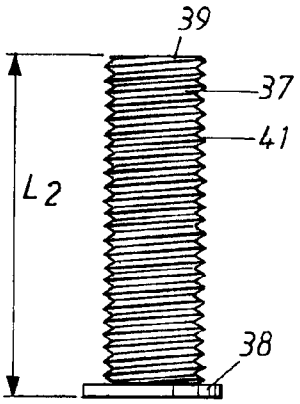
FIG. 10 is a stop sleeve similar to the one in FIG. 9, but provided with a fixed terminal flange.
Figure 11:
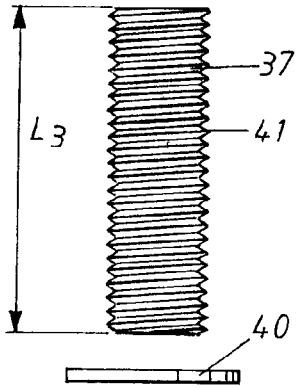
FIG. 11 is a stop sleeve similar to the one in FIG. 9, but provided with a loose washer, on which the stop sleeve rests in its operative position.

To eliminate penetration of the stop sleeve 37 into the substructure 14, a loose annular washer or flange or the like can be arranged at the lower end of the stop sleeve 37. In the embodiment in accordance with FIG. 10, the stop sleeve 37 is provided with a flange 38, which is rigidly connected to the sleeve body 39. The flange 38 can be made in one piece with the sleeve body 39. In the embodiment in accordance with FIG. 11, the stop sleeve 37 is provided with a loose annular washer 40, on which the sleeve body 39 rests. The flange 38 and the washer 40 rest on the substructure 14 without penetrating the same. The distance between the upper end of the sleeve body 39 and the underside of the flange 38 or washer 40, respectively, corresponds to the length of the damping body 26.

The stop sleeve 37 has an uneven exterior 41 without vertical surface areas, so that only oblique surface areas, forming an angle with the longitudinal direction of the stop sleeve 37, are formed. This prevents relative movements between vertical surfaces on the inside of the damping body 26 and the exterior of the stop sleeve 37, which movements can give rise to undesirable noises in the construction. On the stop sleeves 37 shown, the uneven exterior is formed by radial, circumferential protrusions, having oblique surface areas. The protrusions can favorably be formed by a continuous thread, extending along the exterior of the entire stop sleeve 37. The uneven exterior 41 can also be formed by knurling, for instance.

At its end surface 29, the damping body 26 can be provided with a recess for the flange 38 or washer 40, respectively, if so desired.

What is claimed is:

1. A building construction for floors, walls or ceilings with a rigid substructure, comprising:

a plurality of parallel joists; and at least one covering layer supported by the joists, which joists each comprise an elongate, form-stable body with a first side that is flat and faces the covering layer and a second side that faces the substructure, which joist body has threaded, through-running holes, spaced from each other and extending between and perpendicularly to said first and second sides, and load-carrying level-adjusting spacer screws that are screwed into said holes with their anterior screw portions protruding from the joist body on its second side to adjust the first side of the joist body to a desired level and that have a length such that their posterior screw portions, situated inside the joist body to maintain sufficient thread engagement, have a part-length of at least 10 mm whilst said anterior screw portions have a part-length of at least 1 mm to form an air gap, which extends from said second side of the joist body, each level-adjusting spacer screw being provided with a central hole, extending from the posterior end of the level-adjusting spacer screw to a location a distance from the anterior end of the level-adjusting spacer screw to form a bottom part with an inner support surface, and the level-adjusting spacer screw being arranged to be anchored to the substructure by means of an attachment element, extending through a central hole in said bottom part, an elastic damping body being arranged at the anterior screw portion, which damping body has a central hole and comprises an outer part, arranged to form a spring connection between the level-adjusting spacer screw and the substructure, and an inner part, arranged to be received in said central hole in the level-adjusting spacer screw, wherein the inner part of the damping body forms a resilient engagement element for cooperation with said inner support surface of the bottom part, said attachment element being arranged to extend through the central hole of the damping body, and said inner part having a cross-sectional dimension that is greater than the diameter of the central hole of said bottom part.

2. A building construction as claimed in claim 1, wherein the damping body includes an intermediary part uniting the outer and inner parts with each other and having a cross-sectional dimension that is smaller than the diameter of the inner part for defining an annular groove around the intermediary part to engage said bottom part of the level-adjusting spacer screw, the intermediary part being arranged to be received in the central hole of the bottom part, and wherein the outer and inner parts and the intermediary part are made in one piece.

3. A building construction as claimed in claim 1, wherein the outer part has a cross-sectional dimension that is substantially equal to the diameter of the level-adjusting spacer screw.

4. A building construction as claimed in claim 1, wherein the outer part has an axial extension at least 5 mm.

5. A building construction as claimed in claim 1, wherein the inner part has an axial extension of at least 5 mm and not more than 15 mm.

6. A building construction as claimed in claim 1, further comprising spring elements that are placed on the joists, which spring elements have a rectangular cross section, extend along the joists without any interstice-forming hiatuses and include a compressible, rubber-like, foamed material with a density of 100–400 kg/m$^3$ and a compression modulus of 1–20 MPa.

7. A building construction as claimed in claim 6, wherein the spring elements are manufactured of recycled polyurethane material.

8. A building construction as claimed in claim 6, wherein the spring elements have a thickness of 10–50 mm, and wherein the joists as well as the spring elements resting thereon are spaced at a distance from each other of 10–50 cm.

9. A building construction as claimed in claim 6, wherein said covering layer comprises a support layer, including wood or particle board in one or several layers, and a resilient top layer, including a rubber mat that is covered with a layer of polyurethane on site or of a prefabricated mat with built-in spring capacity.

10. A building construction as claimed in claim 1, wherein the damping body is manufactured of a rubber material or a plastic material with rubber-like qualities, and wherein the damping body has a Shore number of about 30–90 on Scale A.

11. A building construction as claimed in claim 1, wherein the damping body comprises an internal stop sleeve, extending through said central hole to cooperate with the head of the attachment element and with the substructure, the attachment element extending through the stop sleeve.

12. A building construction as claimed in claim 11, wherein the stop sleeve is longer than the damping body to permit corresponding penetration of the stop sleeve into the substructure.

13. A building construction as claimed in claim 11, wherein the stop sleeve has a length corresponding to the length of the damping body and is provided with a fixed flange or a loose washer, included in said length.

14. A building construction as claimed in claim 11, wherein the stop sleeve has an uneven exterior such that the stop sleeve exterior is substantially free from vertical surface areas.

15. A building construction as claimed in claim 14, wherein the uneven exterior is formed by radial, circumferential protrusions.

16. A building construction as claimed in claim 15, wherein the protrusions are formed by a continuous thread, extending from end to end on the stop sleeve.

17. A building construction as claimed in claim 4, wherein the outer part has an axial extension of at least 8 mm.

18. A building construction as claimed in claim 5, wherein the inner part has an axial extension of at least 8 mm.

19. A building construction as claimed in claim 6, wherein the compressible, rubber-like, foamed material has a density of 195–200 kg/m$^3$ and a compression modulus of 3–5 MPa.

20. A building construction as claimed in claim 8, wherein the spring elements have a thickness of about 30 mm, and wherein the joists as well as the spring elements resting thereon are spaced at a distance from each other of 30–40 cm.

21. A building construction as claimed in claim 10, wherein the damping body has a Shore number of about 55–75 on Scale A.

22. Joists for a building construction for floors, walls or ceilings with a rigid substructure, which joists support at least one covering layer, and which each comprise an elongate, form-stable body with a first side that is flat and faces the covering layer and a second side that faces the substructure, the joist body having threaded, through-running holes, spaced from each other and extending between and perpendicularly to said first and second sides, and load-carrying level-adjusting spacer screws that are screwed into said holes with anterior screw portions protruding from the joist body on said second side to adjust the first side of the joist body to a desired level and that have a length such that posterior screw portions, situated inside the joist body to maintain sufficient thread engagement, have a part-length of at least 10 mm, whilst said anterior screw portions have a part-length of at least 1 mm, to form an air gap, which extends from said second side of the joist body, each level-adjusting spacer screw being provided with a central hole, extending from the posterior end of the level-adjusting spacer screw to a location a distance from the anterior end of the level-adjusting spacer screw to form a bottom part with an inner support surface, and the level-adjusting spacer screw being arranged to be anchored to the substructure by means of an attachment element, extending through a central hole in said bottom part, an elastic damping body being arranged at the anterior screw portion, which damping body has a central hole and comprises an outer part, arranged to form a spring connection between the level-adjusting spacer screw and the substructure, and an inner part, arranged to be received in said central hole in the level-adjusting spacer screw, wherein the inner part of the damping body forms a resilient engagement element for cooperation with said inner support surface of the bottom part, said attachment element being arranged to extend through the central hole of the damping body, and said inner part has a cross-sectional dimension that is greater than the diameter of the central hole of said bottom part.

23. Joists as claimed in claim 22, wherein the damping body includes an intermediary part uniting the outer and inner parts with each other and having a cross-sectional dimension that is smaller than the diameter of the inner part for defining an annular groove around the intermediary part to engage said bottom part of the level-adjusting spacer screw, the intermediary part being arranged to be received in the central hole of the bottom part, and wherein the outer and inner parts and the intermediary part are made in one piece.

24. Joists as claimed in claim 22, wherein the outer part has a cross-sectional dimension that is equal to or substantially equal to the diameter of the level-adjusting spacer screw.

25. Joists as claimed in claim 22, wherein the outer part has an axial extension of at least 5 mm.

26. Joists as claimed in claim 22, wherein the inner part has an axial extension of at least 5 mm and not more than 15 mm.

27. Joists as claimed in claim 22, wherein the damping body is manufactured of a rubber material or a plastic material with rubber-like qualities and wherein the damping body has a Shore number of about 30–90 on Scale A.

28. Joists as claimed in claims 22, wherein the damping body comprises an internal stop sleeve, extending through said central hole to cooperate with the head of the attachment element and with the substructure, the attachment element extending through the stop sleeve.

29. Joists as claimed in claim 28, wherein the stop sleeve is somewhat longer than the damping body to permit corresponding penetration of the stop sleeve into the substructure.

30. Joists as claimed in claim 28, wherein the stop sleeve has a length corresponding to the length of the damping body and is provided with one of a fixed flange or a loose washer, included in said length.

31. Joists as claimed in claim 28, wherein the stop sleeve has an uneven exterior such that the stop sleeve exterior is substantially free from vertical surface areas.

32. Joists as claimed in claim 31, wherein the uneven exterior is formed by radial, circumferential protrusions.

33. Joists as claimed in claim 32, wherein the protrusions are formed by a continuous thread, extending from end to end on the stop sleeve.

34. Joists as claimed in claim 25, wherein the outer part has an axial extension of at least 8 mm.

35. Joists as claimed in claim 26, wherein the inner part has an axial extension of at least 8 mm.

36. Joists as claimed in claim 27, wherein the damping body has a Shore number of about 55–75 on Scale A.

37. A level-adjusting spacer screw for use in a building construction, the level-adjusting spacer screw being provided with a central hole, extending from the posterior end of the level-adjusting spacer screw to a location a distance from the anterior end of the level-adjusting spacer screw to form a bottom part with an inner support surface, and the level-adjusting spacer screw being arranged to be anchored to a substructure of the building construction by means of an attachment element, extending through a central hole in said bottom part, an elastic damping body being arranged at the anterior screw portion, which damping body has a central hole and comprises an outer part, arranged to form a spring connection between the level-adjusting spacer screw and the substructure, and an inner part, arranged to be received in said central hole in the level-adjusting spacer screw, wherein the inner part of the damping body forms a resilient engagement element for cooperation with said inner support surface of the bottom part, said attachment element being arranged to extend through the central hole of the damping body, and said inner part has a cross-sectional dimension that is greater than the diameter of the central hole of said bottom part.

38. A level-adjusting spacer screw as claimed in claim 37, wherein the damping body includes an intermediary part uniting the outer and inner parts with each other and having a cross-sectional dimension that is smaller than the diameter of the inner part for defining an annular groove around the intermediary part to engage said bottom part of the level-adjusting spacer screw, the intermediary part being arranged to be received in the central hole of the bottom part, and wherein the outer and inner parts and the intermediary part are made in one piece.

39. A level-adjusting spacer screw as claimed in claim 37, wherein the outer part has a cross-sectional dimension that is equal to or substantially equal to the diameter of the level-adjusting spacer screw.

40. A level-adjusting spacer screw as claimed in claim 37, wherein the outer part has an axial extension of at least 5 mm.

41. A level-adjusting spacer screw as claimed in claim 37, wherein the inner part has an axial extension of at least 5 mm and not more than 15 mm.

42. A level-adjusting spacer screw as claimed in claim 37, comprising spring elements that are placeable on joists of the building construction, which spring elements have a rectangular cross section, extendable along the joists without any interstice-forming hiatuses and consist of a compressible, rubber-like, foamed material with a density of 100–400 kg/m$^3$ and a compression modulus of 1–20 MPa.

43. A level-adjusting spacer screw as claimed in claim 42, wherein the spring elements are manufactured of recycled polyurethane material.

44. A level-adjusting spacer screw as claimed in claim 42, wherein the spring elements have a thickness of 10–50 mm.

45. A level-adjusting spacer screw as claimed in claim 37, wherein the damping body is manufactured of one of a rubber material or a plastic material with rubber-like qualities, and wherein the damping body has a Shore number of about 30–90 on Scale A.

46. A level-adjusting spacer screw as claimed in claim 37, wherein the damping body comprises an internal stop sleeve, extending through said central hole to cooperate with the head of the attachment element and with the substructure, the attachment element extending through the stop sleeve.

47. A level-adjusting spacer screw as claimed in claim 46, wherein the stop sleeve is longer than the damping body to permit corresponding penetration of the stop sleeve into the substructure.

48. A level-adjusting spacer screw as claimed in claim 46, wherein the stop sleeve has a length corresponding to the length of the damping body and is provided with one of a fixed flange or a loose washer, included in said length.

49. A level-adjusting spacer screw as claimed in claim 46, wherein the stop sleeve has an uneven exterior such that the stop sleeve exterior is substantially free from vertical surface areas.

50. A level-adjusting spacer screw as claimed in claim 49, wherein the uneven exterior is formed by radial, circumferential protrusions.

51. A level-adjusting spacer screw as claimed in claim 50, wherein the protrusions are formed by a continuous thread, extending from end to end on the stop sleeve.

52. A level-adjusting spacer screw as claimed in claim 40, wherein the outer part has an axial extension of at least 8 mm.

53. A level-adjusting spacer screw as claimed in claim 41, wherein the inner part has an axial extension of at least 8 mm.

54. A level-adjusting spacer screw as claimed in claim 42, wherein the compressible, rubber-like, foamed material has a density of 195–200 kg/m$^3$ and a compression modulus of 3–5 MPa.

55. A level-adjusting spacer screw as claimed in claim 44, wherein the spring elements have a thickness of about 30 mm.

56. A level-adjusting spacer screw as claimed in claim 45, wherein the damping body has a Shore number of about 55–75 on Scale A.

* * * * *

UNITED STATES PATENT AND TRADEMARK OFFICE

CERTIFICATE OF CORRECTION

PATENT NO. : 6,584,745 B1
DATED : July 1, 2003
INVENTOR(S) : Johansson

It is certified that error appears in the above-identified patent and that said Letters Patent is hereby corrected as shown below:

Title page,
Item [86], delete "[86], PCT No.: PCT/SE00/00679
§ 371 (c)(1),
(2), (4) Date: August 21, 2000" and insert therefor
-- [86] PCT No.: PCT/SE00/00679
§ 371 (c)(1),
(2), (4) Date: August 21, 2001 --.

Column 3,
Line 58, delete "15 25 cm" and insert therefor -- 15-25 cm --;

Column 6,
Line 42, delete "central hole 1" and insert therefor -- central hole 11 --.

Signed and Sealed this

Twenty-first Day of October, 2003

JAMES E. ROGAN
*Director of the United States Patent and Trademark Office*